US006490896B2

(12) United States Patent
Segawa

(10) Patent No.: US 6,490,896 B2
(45) Date of Patent: Dec. 10, 2002

(54) DOOR LOCKING HANDLE ASSEMBLY OF PULL-OUT AND SIDE-SWINGING LEVER-ACTION TYPE

(75) Inventor: Shirou Segawa, Tokyo (JP)

(73) Assignee: Takigen Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/096,969

(22) Filed: Mar. 13, 2002

(65) Prior Publication Data

US 2002/0152778 A1 Oct. 24, 2002

(30) Foreign Application Priority Data

Apr. 23, 2001 (JP) ..... 2001-124228

(51) Int. Cl.[7] ..... E05B 13/10

(52) U.S. Cl. ..... 70/208; 70/210; 70/215; 70/257; 70/279.1; 292/336.3; 292/DIG. 31

(58) Field of Search ..... 70/208, 210, 215, 70/257, 279.1; 292/336.3, DIG. 31

(56) References Cited

U.S. PATENT DOCUMENTS 4,167,104 A * 9/1979 Bond ..... 70/208
4,268,076 A * 5/1981 Itoi ..... 292/216
5,058,258 A * 10/1991 Harvey ..... 70/257 X
5,295,374 A * 3/1994 Bender et al. ..... 70/208
5,484,179 A * 1/1996 Mader ..... 292/336.3
5,813,257 A * 9/1998 Claghorn et al. ..... 70/208
6,038,896 A * 3/2000 Chamberlain et al. ..... 70/279.1
6,241,294 B1 * 6/2001 Young et al. ..... 292/336.3
6,341,512 B1 * 1/2002 Ramsauer ..... 70/208
6,427,501 B2 * 8/2002 Ramsauer ..... 70/208

FOREIGN PATENT DOCUMENTS

FR 2617528 * 1/1989 ..... 70/279.1

* cited by examiner

*Primary Examiner*—Lloyd A. Gail
(74) *Attorney, Agent, or Firm*—Martin Smolowitz

(57) ABSTRACT

In a door lock handle assembly of pull-out and side-swinging lever-action type, an operating handle is released from its retracted position without fail upon receipt of an unlocking signal issued from a site remote from the handle assembly, and is automatically locked again to the retracted position when pushed back into the retracted position. A solenoid (12) is fixedly mounted on a rear surface of a housing (2). A latch portion (7) is formed in a receiving lever plate (13) pivoted to the housing (2). The solenoid (12) has its plunger (14) pivoted to the lever plate (13) which is rotatably biased by a spring (15) in the direction in which the lever plate (13) is engaged with a stopper plate (8). When the solenoid (12) is energized, the lever plate (13) is pulled back to have the latch portion (7) disengaged from the stopper plate (8).

2 Claims, 3 Drawing Sheets

DOOR LOCKING HANDLE ASSEMBLY OF PULL-OUT AND SIDE-SWINGING LEVER-ACTION TYPE

BACKGROUND OF THE INVENTION

1. Field of the Invention

The present invention relates to a door locking handle assembly of a pull-out and side-swinging lever-action type, through which assembly a door of an instrument box and the like for receiving various types of instruments therein is locked to a stationary frame element of the instrument box and the like.

2. Description of the Related Art

A conventional door locking handle assembly of a pull-out and side-swinging lever-action type such as one disclosed in Japanese Patent No. 2969118, for example, comprises: a housing fixedly mounted on a door which is swingably mounted on a stationary frame; an operating handle which has at least its main body portion retractably received in said housing and its proximal-end portion pivoted to a front-end portion of a main locking shaft; a lock unit which is incorporated in the operating handle and provided with a rotor which is provided with a keyhole; and, a stopper plate which is connected with the rotor and releasably engaged with a latch portion provided in the side of said housing. In operation, the operating handle is released from the retracted position in the housing when the key inserted into the keyhole is rotatably driven in a suitable direction, which permits the operating handle thus released from the retracted position to side-swing and rotatably drive the main locking shaft to unlock the door from the stationary frame.

In the conventional door locking assembly having the above construction, it is impossible for an instrument-box management person to release the operating handle from its retracted position in the housing when he or she does not insert the key into the lock unit of the assembly at a site where the instrument box is installed.

Due to this, when the office of the instrument-box management person is remote from the installation site of the instrument box, it is necessary for the instrument-box management person to travel between the office and the box's installation site at much expense in time.

SUMMARY OF THE INVENTION

Consequently, it is an object of the present invention to provide a door lock handle assembly of a pull-out and side-swinging lever-action type, which assembly is capable of releasing an operating handle from its retracted position in a housing upon receipt of an unlocking signal which is issued by an instrument-box management person from a site remote from the installation site of an instrument box, wherein the operating handle is automatically locked again to its retracted position when a worker sent by the person pushes the operating handle into its retracted position.

In accordance with a first aspect of the present invention, the above object of the present invention is accomplished by providing:

In door locking handle assembly of a pull-out and side-swinging lever-action type comprising: a housing fixedly mounted on a door which is swingably mounted on a stationary frame; an operating handle which has at least its main body portion retractably received in the housing and its proximal-end portion pivoted to a front-end portion of a main locking shaft; a lock unit which is incorporated in the operating handle and provided with a rotor which is provided with a keyhole; and, a stopper plate which is connected with the rotor and releasably engaged with a latch portion provided in the side of the housing, wherein the operating handle is released from the retracted position in the housing when the key inserted into the keyhole is rotatably driven in a suitable direction, which permits the operating handle thus released from the retracted position to side-swing and rotatably drive the main locking shaft to unlock the door from the stationary frame, the improvement wherein:

a solenoid is provided with a plunger and fixedly mounted on a rear surface of the housing;

the latch portion is formed in a receiving lever plate;

the receiving lever plate is pivoted to each of the housing and the plunger, and rotatably biased by a spring in a direction in which the latch portion of the receiving lever plate is engaged with the stopper plate; and the latch portion of the receiving lever plate is released from the stopper plate when the solenoid is energized to pull back the receiving lever plate.

In accordance with a second aspect of the present invention, the above object of the present invention is accomplished by providing:

The door locking handle assembly of the pull-out and side-swinging lever-action type as set forth in the first aspect of the present invention, wherein:

the housing is provided with an opening portion for receiving the receiving lever plate therein;

the proximal-end portion of the receiving lever plate is pivoted to the housing through a pivot which passes through opposite side wall portions of the housing, the side wall portions being so arranged as to sandwich the opening portion of the housing therebetween;

the plunger of the solenoid is pivoted to an intermediate portion of the receiving lever plate;

a support plate portion is formed in a front-end portion of the receiving lever plate to abut against an edge wall portion of a rear surface of the opening portion; and the latch portion is formed in a root portion of the support plate portion.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

The best modes for carrying out the present invention will be described in detail using embodiments of the present invention with reference to the accompanying drawings.

First Embodiment

Figure 1:
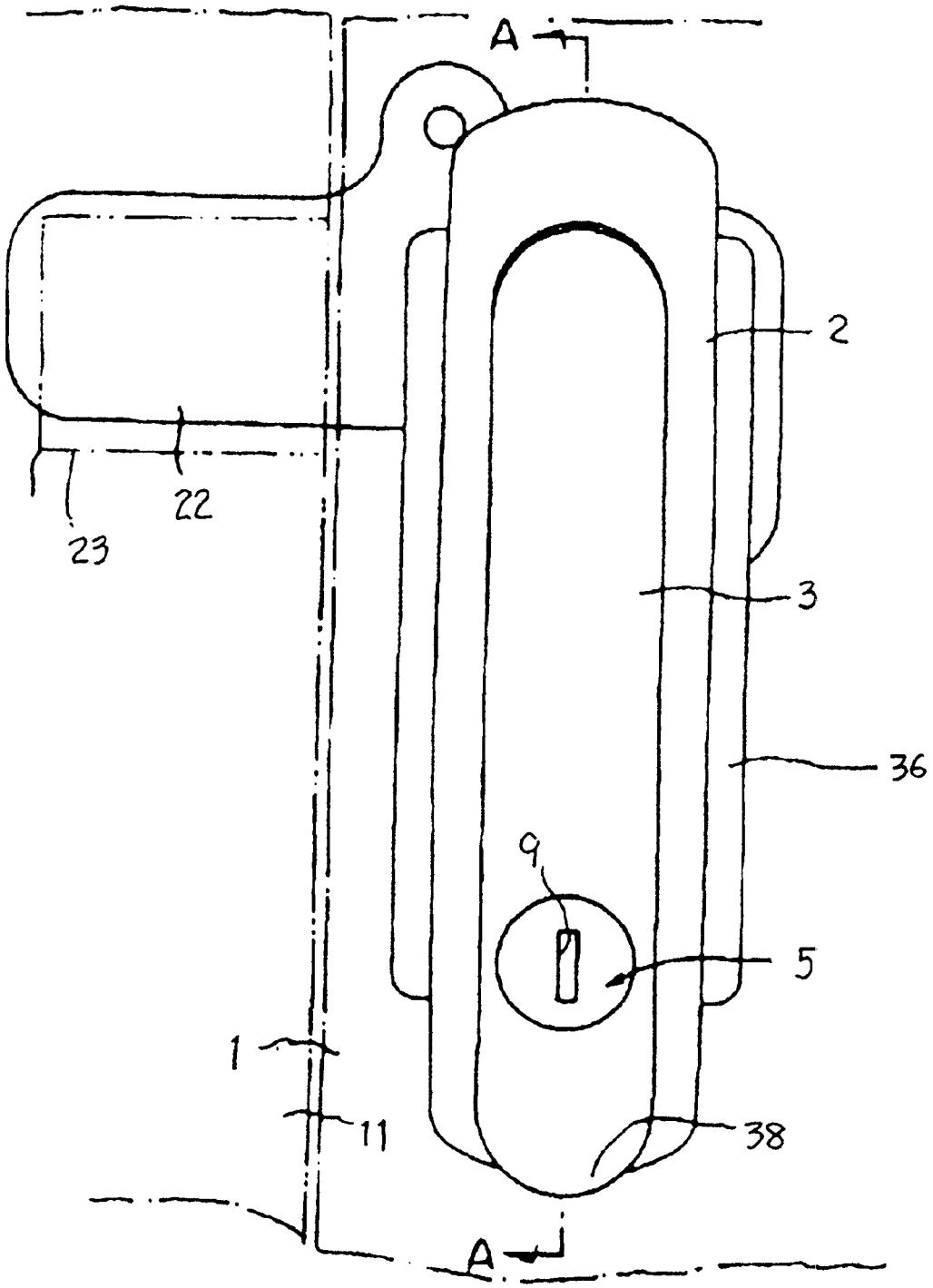
FIG. 1 is a front view of the door lock handle assembly of an embodiment of the present invention, illustrating the door in its closed and locked position.
Figure 2:
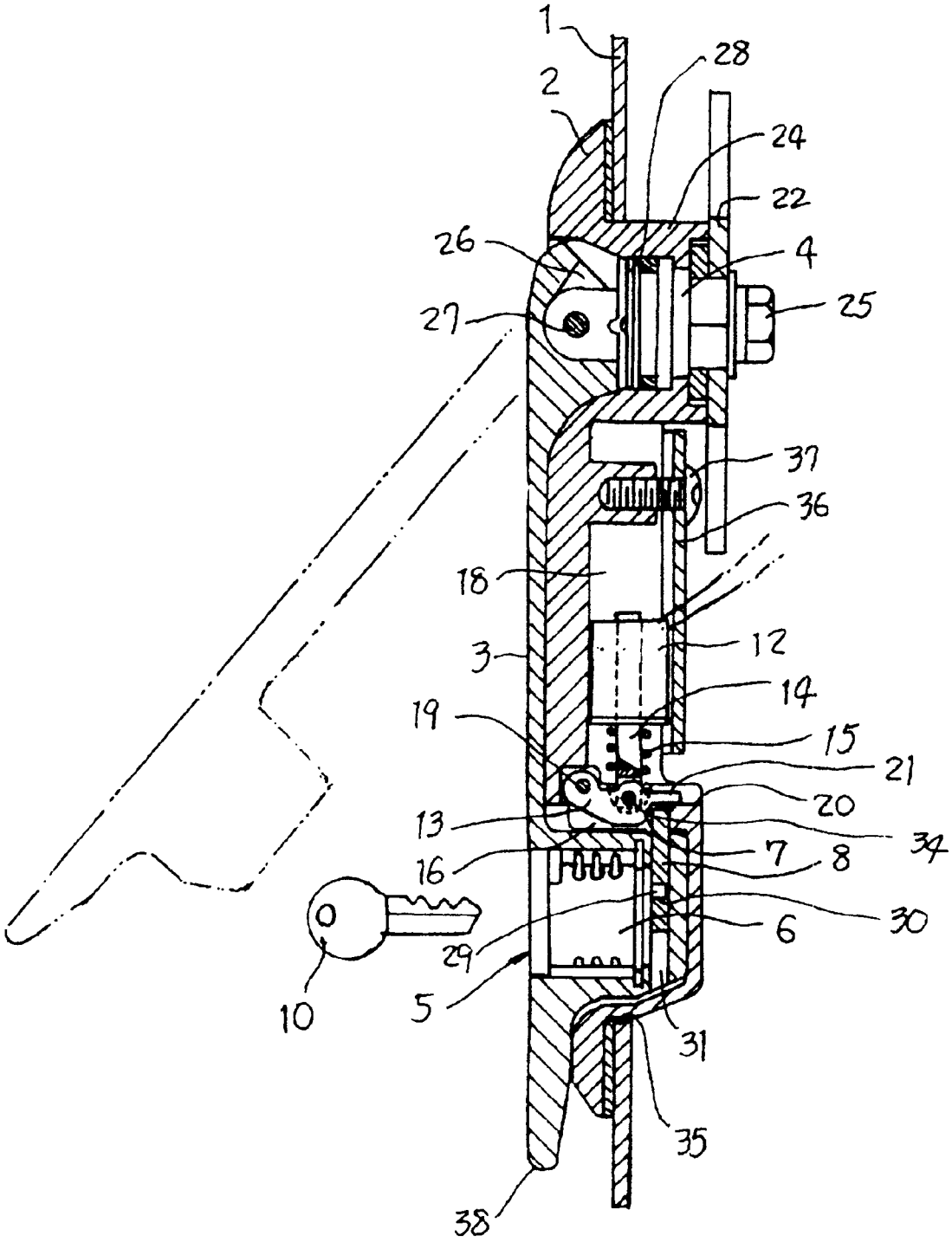
FIG. 2 is a longitudinal sectional view of the door lock handle. assembly of the present invention, taken along the line A—A of FIG. 1.
Figure 3:
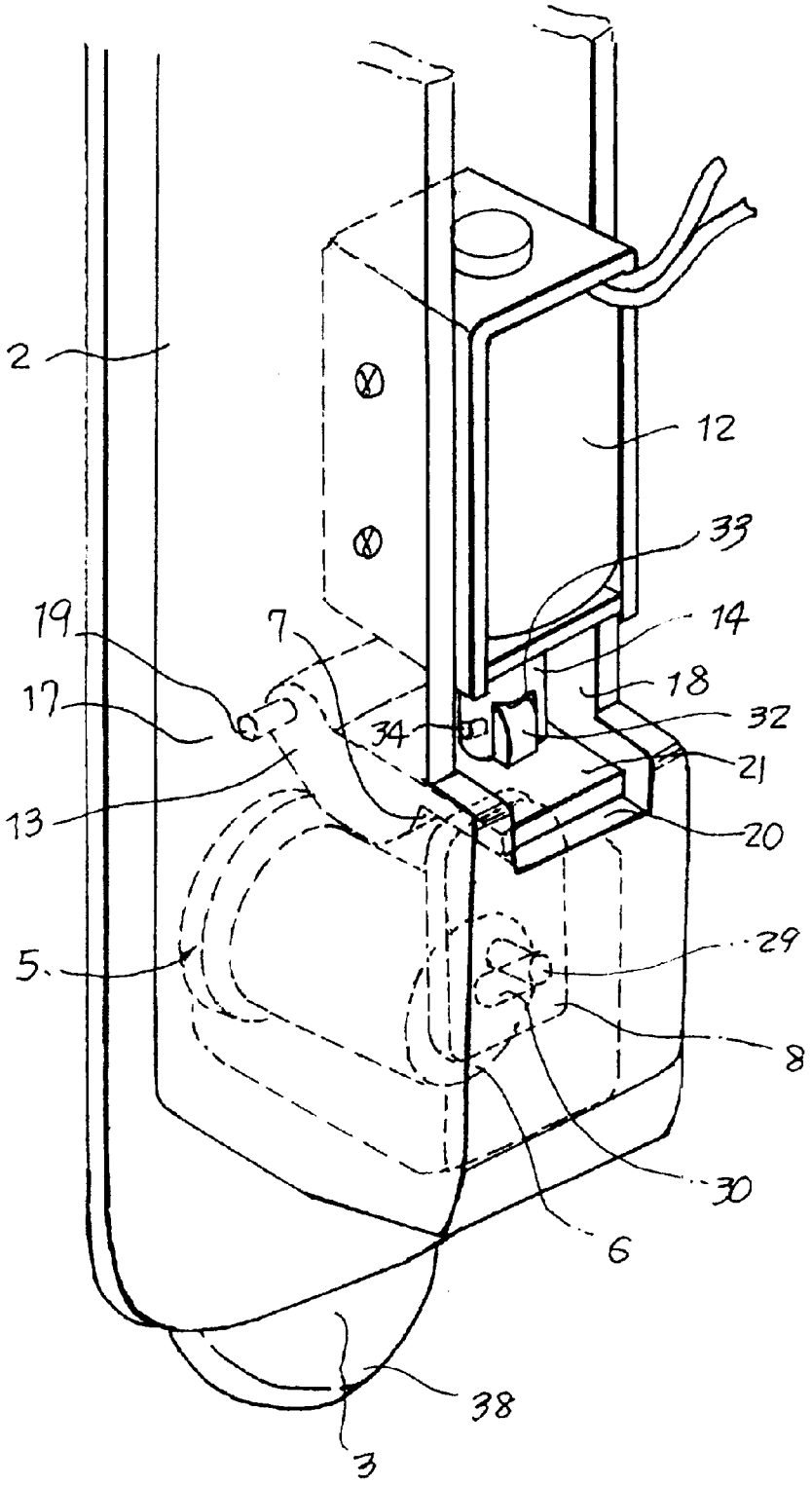
FIG. 3 is a schematic perspective view of the door locking handle assembly of the present invention shown in FIG. 1, illustrating the rear side of an essential part of the door locking handle assembly.

As shown in FIGS. 1 and 2, a first embodiment of a door lock handle assembly of a pull-out and side-swinging lever-action type of the present invention comprises: a housing 2 fixedly mounted on a door 1 which is swingably mounted on a stationary frame 11, for example such as a main body of an instrument box and the like; an operating handle 3 which has at least its main body portion retractably received in the housing 2 and its proximal-end portion pivoted to a front-end portion of a main locking shaft 4, as shown in FIG. 2; a lock unit 5 which is incorporated in the operating handle 3 and provided with a rotor 6 which is provided with a keyhole 9; and, a stopper plate 8 which is connected with the rotor 6 and releasably engaged with a latch portion 7 provided in the side of the housing 2, wherein the operating handle 3 is released from the retracted position thereof in the housing 2 when a predetermined key 10 inserted into the keyhole 9 is rotatably driven to permit the operating handle 3 thus released from the retracted position to side-swing and rotatably drive the main locking shaft 4 so as to unlock the door 1 from the stationary frame 11.

In the door lock handle assembly of the present invention having the above construction, a solenoid 12 is provided with a plunger 14 and fixedly mounted on a rear surface of the housing 2. The latch portion 7 is formed in a receiving lever plate 13. This receiving lever plate 13 is pivoted to each of the housing 2 and the plunger 14, and rotatably biased by a spring 15 in a direction in which the latch portion 7 of the receiving lever plate 13 is engaged with the stopper plate 8. The latch portion 7 of the receiving lever plate 13 is released from the stopper plate 8 when the solenoid 12 is energized to pull back or up the receiving lever plate 13.

In a second embodiment of the door lock handle assembly of the present invention, the housing 2 is provided with an opening portion 16 for receiving the receiving lever plate 13 therein. The proximal-end portion of the receiving lever plate 13 is pivoted to the housing 2 through a pivot 19 which passes through opposite side wall portions 17, 18 of the housing 2. These side wall portions 17, 18 are so arranged as to sandwich the opening portion 16 of the housing 2 therebetween. On the other hand, the plunger 14 of the solenoid 12 is pivoted to an intermediate portion of the receiving lever plate 13. Formed in a front-end portion of the receiving lever plate 13 is a support plate portion 21 which abuts against an edge wall portion 20 provided in a rear surface of the opening portion 16 of the housing 2. The latch portion 7 is formed in a root portion of the support plate portion 21.

As shown in FIGS. 1 and 2, in a condition in which the door 1 is closed and locked to the stationary frame 11 such as a main body of the instrument box and the like by means of a locking means 22 connected with the main locking shaft 4, the operating handle 3 has at least its main body portion received in the housing 2, while the stopper plate 8 of the lock unit 5 engages with the latch portion 7 of the receiving lever plate 13 to receive and hold the operating handle 3 in the housing 2, so that the operating handle 3 is prevented from being pulled out of the housing 2.

In case that the instrument-box management person sends a worker to the installation site of the instrument box in order to operate instruments housed in the instrument box or check and repair such instruments, the instrument-box management person turns on a suitable switch of a control panel to supply a predetermined amount of electric current serving as an unlocking signal to the solenoid 12. The solenoid 12 thus energized by the above unlocking signal attracts the plunger 14 to the side of its main body. Due to such magnetic attraction of the plunger 14, the receiving lever plate 13 is pulled back or up so as to have its part or its entire body pulled out of the opening portion 16 of the housing 2, so that the stopper plate 8 is released from the latch portion 7 of the receiving lever plate 13.

At this time, since the lock unit 5 is not operated at all, the stopper plate 8 remains inserted into the opening portion 16 of the housing 2.

When the worker having been sent to the installation site of the instrument box to be checked or repaired pulls the operating handle 3 out of the housing 2, the stopper plate 8 is so driven as to partially pass through the opening portion 16 and move out of the housing 2. After completion of such pulling operation of the operating handle 3 out of the housing 2, the solenoid 12 is de-energized so that the receiving lever plate 13 returns to its protruding position in the opening portion 16 under the influence of a resilient force exerted by the spring 15.

When the worker takes a grip on the operating handle 3 thus pulled out of the housing 2 and then rotatably drives the main locking shaft 4 in a suitable direction, the locking means 22 connected with the main locking shaft 4 is released from a receiving portion 23 of the stationary frame 11, whereby the door 1 is unlocked from the stationary frame 11. As a result, it is possible for the worker to open the door by pulling the operating handle 3 forward.

After completion of daily performance checks and needed repairs of the instruments, the door is closed again through the following operation: namely, when the operating handle 3 is pushed back and returned into its retracted position in the housing 2, a top-end portion of the stopper plate 8 pushes a side surface of the receiving lever plate 13 upward to lift the same 13 against the resilient force exerted by the spring 15, which permits the stopper plate 8 to pass through the receiving lever plate 13 having been thus partially lifted up in the opening portion 16 of the housing 2. When the top-end portion of the stopper plate 8 passes through the latch portion 7 of the receiving lever plate 13, the receiving lever plate 13 is rotatably driven downward under the influence of the resilient force exerted by the spring 15, so that the top-end portion of the stopper plate 8 is engaged again with the latch portion 7 of the receiving lever plate 13.

In the embodiment of the present invention shown in the drawings, the main locking shaft 4 is rotatably, but not axially slidably, received in a bearing sleeve portion 24 which is formed in a rear-side portion of the housing 2. Fixedly or not rotatably mounted on a square-shaped rear-end portion of the main locking shaft 4 is the locking means 22 (shown in FIG. 1) which is constructed of a substantially L-shaped plate. The locking means 22 is fixedly mounted on the main locking shaft 4 by fastening a bolt 25. On the other hand, a front-end portion of the main locking shaft 4 is received in a rear-side concave portion 26 formed in a proximal-end portion of the operating handle 3. The operating handle 3 is pivoted to this front-end portion of the main locking shaft 4 through a cross pivot 27 in a manner such that the operating handle 3 is capable of swingably moving from its pulled-out (i.e., erected) position to its retracted position.

Mounted between the operating handle 3 and the main locking shaft 4 is a click mechanism 28 comprising a disc-type spring washer. The click mechanism 28 functions to hold the operating handle 3 in any one of its angular positions comprising: its erected or pulled-out position shown in phantom lines in FIG. 2; and, its unlocked position (not shown), which is spaced sideward approximately 90 degree in angular position apart from the erected position of the operating handle 3.

The lock unit 5 is fixedly embedded in a distal-end portion of the operating handle 3, and has its rotor 6 locked to a main body of the unit 5 through an internal mechanism known as "Disc tumbler lock mechanism". Projected from a rear-end surface of the rotor 6 is a cam projection 29, which is deviated in center from a rotation axis of the rotor 6. The stopper plate 8 is inserted into a guide groove 31, which is formed in the operating handle 3 to extend vertically as shown in FIG. 2. Formed in the stopper plate 8 is a horizontally elongated slot 30 into which the cam projection 29 of the rotor 6 is inserted.

In operation, the predetermined key 10 is inserted into the keyhole 9 of the rotor 6 to permit the rotor 6 to rotate relative to the lock's main body. When the rotor 6 is rotated through a predetermined angle by means of the key 10, the cam projection 29 of the rotor 6 cooperates with the horizontally elongated slot 30 to move the stopper plate 8 downward along the guide groove 31, so that a top-end portion of the stopper plate 8 escapes from the opening portion 16 of the housing 2 to disengage the latch portion 7 of the receiving lever plate 13 from the top-end portion of the stopper plate 8.

The receiving lever plate 13 is pivoted to the opposite side wall portions 17, 18 of the housing 2 through the pivot 19 which extends in parallel with a front surface of the door 1. Provided in a protruding manner in an upper surface of an intermediate portion of the receiving lever plate 13 is a connecting plate portion 32, which is inserted into a slot portion formed in a lower-end portion of the plunger 14. This connecting plate portion 32 is connected with the plunger 14 through a pivot 34 which extends in parallel with a front surface of the door 1. The spring 15 for biasing the receiving lever plate 13 is constructed of a compression coil spring, and also serves as a return spring for returning the plunger 14 of the solenoid 12 to its initial position. In a condition in which the solenoid 12 is de-energized, the plunger 14 is subjected only to a resilient force exerted the spring 15, which permits the plunger 14 to move up and down to follow the motion of the receiving lever plate 13.

The latch portion 7 of the receiving lever plate 13 has its part, which faces the stopper plate 8, formed into a circularly curved shape in contour. A center of this curved shape of the latch portion is coincident in position with the pivot 19. Due to this arrangement, the latch portion 7 of the receiving lever plate 13 is free from any interference from the top-end portion of the stopper plate 8 when the receiving lever plate 13 is pulled by the plunger 14 to rotate its latch portion 7 about the pivot 19.

It is also possible to have the latch portion 7 be free from the above interference by the provision of a suitable clearance between the latch portion 7 and the top-end portion of the stopper plate 8 even when the latch portion 7 has the above part thereof formed into a rectangular shape. In this case, in a condition in which the operating handle 3 is locked up, it is possible for the operating handle 3 to slightly move back and forth relative to the housing 2. Incidentally, the housing 2 is embedded in a mounting hole 35 of the door 1 from a front surface of the door 1. Then, both a washer plate 36 and a screw 37 are applied to a rear surface of the door 1. After that, the screw 37 is fastened and threadably engaged with a female screw formed in the housing 2, so that the housing 2 is fixedly mounted on the door 1.

A lower-end portion of the operating handle 3 slightly protrudes downward from a lower-end portion of the housing 2 to form a finger-tip (i.e.,-engaging) portion 38.

In a condition in which the operating handle 3 is locked up, when the operating handle 3 is forcibly pulled forward, such external kinetic force applied to the operating handle 3 is transmitted to the receiving lever plate 13 through the stopper plate 8 of the lock unit 5 and the latch portion 7 of the receiving lever plate 13, and further transmitted to the opposite side wall portions 17, 18 of the housing 2 and also to the rear-side edge wall portion 20 of the opening portion 16, so that it is hard to deform and damage the receiving lever plate 13 even when the above external kinetic force is applied to the operating handle 3 having been locked up.

In the door locking handle assembly according to the first aspect of the present invention described in the above, since it is possible to disengage the stopper plate 8 from the latch portion 7 of the receiving lever plate 13 without fail by energizing the solenoid 12 with the use of a predetermined amount of electric current serving as an unlocking signal, there is no need for the instrument-box management person to go to the installation site of the instrument box to directly unlock the lock unit. In other words, the box-management person in the office may remote-control a specified one or specified ones of a plurality of the instrument boxes in a manner such that the specified one or ones of the instrument boxes have their doors set in openable conditions, which enables the box-management person in his or her office to perform a centralized control of all the instrument boxes.

Further, since the receiving lever plate 13 is rotatably biased by the spring 15 in a direction in which engagement between the stopper plate 8 and the latch portion 7 is established, and since the latch portion 7 of the receiving lever plate 13 has already returned to its position in the opening portion 16 of the housing 2 when the solenoid 12 is de-energized after the operating handle 3 is pulled out, it is possible for the worker to lock up the operating handle 3 again by simply pushing back the operating handle 3 into the housing 2 since such pushing-back operation of the operating handle 3 into the housing 2 enables the stopper plate 8 to automatically engage with the receiving lever plate 13. As described above, a so-called "auto lock mechanism" is realized in the pushing-back operation of the operating handle 3 so that there is no fear that the worker fails to lock up the operating handle 3, which may eliminate the necessity of the instrument-box management person's on-site checking operation for confirming whether or not the operating handle 3 is correctly locked up by the worker.

Incidentally, even in case of occurrence of electric failures in a driving circuit of the solenoid 12, it is possible to disengage the stopper plate 8 from the receiving lever plate 13 by using the key 10 in a manner such that the key 10 is inserted into the lock unit 5 and rotated in a suitable direction to retract the stopper plate 8 from its projected position shown in FIG. 2, so that there is no fear that the worker fails to open the door 1 of the instrument box for maintenance even in such occurrence of electric failures. This enables the worker to perform the maintenance of the instrument box without fail.

Further, in the door locking handle assembly according to the second aspect of the present invention, in addition to the effects described in connection with the first aspect of the present invention, the following effects will be obtained: namely, the receiving lever plate 13 is less prone to distortion and deformation even when it is subjected to a large external kinetic force, which makes the door locking handle assembly of the pull-out and side-swinging lever-action type according to the present invention excellent in durability due to its construction in which: the housing 2 is provided with the opening portion 16 for receiving the receiving lever plate 13 therein; the proximal-end portion of the receiving lever plate 13 is pivoted to the housing 2 through the pivot 19 which passes through the opposite side wall portions 17, 18 of the housing 2, the side wall portions 17, 18 being so arranged as to sandwich the opening portion 16 of the housing 2 therebetween; the plunger 14 of the solenoid 12 is pivoted to the intermediate portion of the receiving lever plate 13; the support plate portion 21 is formed in the front-end portion of the receiving lever plate 13 to abut against the edge wall portion 20 of the rear surface of the opening portion 16; and, the latch portion 7 is formed in the root portion of the support plate portion 21.

While the present invention has been particularly shown and described with reference to the preferred embodiments thereof, it will be understood by those skilled in the art that various modifications and changes may be made therein without departing from the spirit of the present invention as defined by the appended claims.

What is claimed is:

1. In door locking handle assembly of a pull-out and side-swinging lever-action type comprising: a housing (2) fixedly mounted on a door (1) which is swingably mounted on a stationary frame (11); an operating handle (3) which has at least its main body portion retractably received in said housing (2) and its proximal-end portion pivoted to a front-end portion of a main locking shaft (4), a lock unit (5) which is incorporated in said operating handle (3) and provided with a rotor (6) which is provided with a keyhole (9); and, a stopper plate (8) which is connected with said rotor (6) and releasably engaged with a latch portion (7) provided in the side of said housing (2), wherein said operating handle (3) is released from said retracted position in said housing (2) when a key (10) inserted into said keyhole (9) is rotatably driven in a suitable direction, which permits said operating handle (3) thus released from said retracted position to side-swing and rotatably drive said main locking shaft (4) to unlock said door (1) from said stationary frame (11), the improvement wherein:

a solenoid (12) is provided with a plunger (14) and fixedly mounted on a rear surface of said housing (2);

said latch portion (7) is formed in a receiving lever plate (13);

said receiving lever plate (13) is pivoted to each of said housing (2) and said plunger (14), and rotatably biased by a spring (15) in a direction in which said latch portion (7) of said receiving lever plate (13) is engaged with said stopper plate (8); and said latch portion (7) of said receiving lever plate (13) is released from said stopper plate (8) when said solenoid (12) is energized to pull back said receiving lever plate (13).

2. The door locking handle assembly of the pull-out and side-swinging lever-action type as set forth in claim 1, wherein:

said housing (2) is provided with an opening portion (16) for receiving said receiving lever plate (13) therein;

a proximal-end portion of said receiving lever plate (13) is pivoted to said housing (2) through a pivot (19) which passes through opposite side wall portions (17, 18) of said housing (2), said side wall portions (17, 18) being so arranged as to sandwich said opening portion (16) of said housing (2) therebetween;

said plunger (14) of said solenoid (12) is pivoted to an intermediate portion of said receiving lever plate (13);

a support plate portion (21) is formed in a front-end portion of said receiving lever plate (13) to abut against an edge wall portion (20) of a rear surface of said opening portion (16); and said latch portion (7) is formed in a root portion of said support plate portion (21).

* * * * *